United States Patent [19]

Kato et al.

[11] Patent Number: 4,944,615

[45] Date of Patent: Jul. 31, 1990

[54] PERMANENT MAGNET PRINT HEAD ASSEMBLY WITH A SQUARE MAGNET

[75] Inventors: Shigeki Kato, Chiryu; Yoshihumi Suzuki, Ena, both of Japan

[73] Assignee: Brother Kogyo Kabushiki Kaisha, Nagoya, Japan

[21] Appl. No.: 326,429

[22] Filed: Mar. 20, 1989

Related U.S. Application Data

[63] Continuation of Ser. No. 35,677, Apr. 7, 1987, abandoned.

[30] Foreign Application Priority Data

Apr. 7, 1986 [JP] Japan ..... 61-79586
Apr. 24, 1986 [JP] Japan ..... 61-62946

[51] Int. Cl.[5] ..... B41J 3/12
[52] U.S. Cl. ..... 400/124; 101/93.05
[58] Field of Search ..... 400/124; 101/93.05

[56] References Cited

U.S. PATENT DOCUMENTS

| | | | |
|---|---|---|---|
| 2,397,545 | 4/1946 | Hardinge | 128/92 YV |
| 2,414,882 | 1/1947 | Longfellow | 128/83 |
| 2,441,765 | 5/1948 | Hopkins | 128/92 YK |
| 2,489,870 | 11/1949 | Dzus | 128/92 YF |
| 2,702,543 | 2/1955 | Pugh | 128/92 YV |
| 2,801,631 | 8/1957 | Charnley | 128/92 YV |
| 3,002,514 | 10/1961 | Deyerle | 128/92 YK |
| 3,025,853 | 3/1962 | Mason | 128/92 YK |
| 3,489,143 | 1/1970 | Halloran | 128/92 YK |
| 3,842,825 | 10/1974 | Wagner | 128/92 YV |
| 3,939,498 | 2/1976 | Lee | 128/92 YP |
| 4,003,376 | 1/1977 | McKay | 128/69 |
| 4,101,985 | 7/1978 | Baumann | 128/92 YV |
| 4,120,298 | 10/1978 | Fixel | 128/92 YK |
| 4,172,452 | 10/1979 | Forte | 128/92 YZ |
| 4,225,250 | 9/1980 | Wagner et al. | 400/124 |
| 4,348,120 | 9/1982 | Isobe et al. | 400/124 |
| 4,375,338 | 3/1983 | Mitsuishi | 400/124 |
| 4,411,538 | 10/1983 | Asano et al. | 400/124 |
| 4,438,762 | 3/1984 | Kyle | 128/92 YV |
| 4,488,543 | 12/1988 | Tornier | 128/92 R |
| 4,506,662 | 3/1985 | Anapliotis | 128/92 YF |
| 4,565,193 | 1/1986 | Streli | 128/92 YK |
| 4,573,458 | 3/1986 | Lower | 128/92 Y |
| 4,618,277 | 10/1986 | Asano et al. | 400/124 |
| 4,628,923 | 12/1986 | Medoff | 128/92 YV |
| 4,651,724 | 3/1987 | Berentey | 128/92 YP |
| 4,773,402 | 9/1988 | Asher | 128/92 YP |

FOREIGN PATENT DOCUMENTS

| | | | |
|---|---|---|---|
| 173173 | 10/1982 | Japan | 400/124 |
| 96568 | 6/1983 | Japan | 400/124 |
| 89171 | 5/1984 | Japan | 400/124 |
| 232878 | 12/1984 | Japan | 400/124 |
| 2376 | 1/1985 | Japan | 400/124 |
| 122165 | 6/1985 | Japan | 400/124 |
| 176773 | 9/1985 | Japan | 400/124 |
| 2090745 | 7/1982 | United Kingdom | 128/92 YV |

*Primary Examiner*—David A. Wiecking
*Attorney, Agent, or Firm*—Jones, Tullar & Cooper

[57] ABSTRACT

A print head assembly of a printing device, in which a supporting member, supporting a plurality of armatures, and a permanent magnet member, urging the armatures in one direction by means of its magnetic force, are arranged between a head body, as a yoke member, including a plurality of cores wound individually with solenoid coils, and a guide member having a nose for guiding a number of print wires. All these members are joined together along an assembling axis. The permanent magnet member has a square shape, including a pair of first outer peripheral edges, extending parallel to a print line, and a pair of second outer peripheral edges, extending at right angels to the print line. Thus, the whole print head assembly is rectangular in shape. Retaining projections, protruding along the assembling axis, are formed individually at the corner portions of the outer peripheral portion of the guide member. Corresponding to the retaining projections, engaging recesses are formed individually at the corner portions of the outer peripheral portion of the head body. As the retaining projections engage their corresponding engaging recesses, the print head assembly is assembled so that the individual members thereof are prevented from rotating relatively around the assembling axis.

5 Claims, 9 Drawing Sheets

PERMANENT MAGNET PRINT HEAD ASSEMBLY WITH A SQUARE MAGNET

"This is a continuation of co-pending application Ser. No. 07/035,677 filed on Apr. 7, 1987, now abandoned".

BACKGROUND OF THE INVENTION

The present invention relates to a print head assembly of a printing device, such as a typewriter, printer, or the like, in which armatures are swung by energizing coils, whereby print wires connected to the armatures are moved to a printing position for printing operation.

In a specific configuration of the print head assembly of this type, the armatures are pulled toward cores by means of the magnetic force of a permanent magnet, thereby accumulating an urging force in a resilient member, and holding the print wires in their rest position. When the coils are energized, a magnetic path formed by the permanent magnet is canceled so that the print wires are moved to the printing position by the urging force of the resilient member.

In order to increase the density of arrangement within a limited space, in the case of the aforementioned conventional configuration, a plurality of cores, each wound with a solenoid coil, are arranged in a circular ring, and a ring-shaped yoke member is disposed around the cores. Further, a ring-shaped permanent magnet is attached to the yoke member, thus forming a substantially columnar head.

Examples of such a prior art print head are disclosed in U.S. Pat. Nos. 4,225,250; 4,348,120; 4,411,538; and 4,618,277.

In these conventional arrangements using the print head of a circular general configuration, however, if the head is reduced in size, then the diameter of the permanent magnet is reduced naturally. Accordingly, the permanent magnet has a narrower area for each armature, so that a necessary magnetic force sometimes cannot be secured to hold the armatures in their rest position, against the urging force of the resilient member.

In general, in the prior art print head assembly constructed in this manner, various members are joined together, along an axis, between a head body and a guide member. The head body has a yoke, while the guide member has a nose for guiding the print wires. The joined members include the permanent magnet, a supporting member for swingably supporting the armatures, a spacer, a spring member opposed to the permanent magnet, etc. In order to align these members along the assembling axis, for example, the head body may be formed with positioning pins which are adapted to be fitted in holes in the supporting member or the spacer. Alternatively, the members may be joined together by separate fixing means, such as bolts penetrating them along the assembling axis.

In the print head assembly of this type, the position of each armature, relative to the core of its corresponding electromagnetic device, as well as the stroke of the armatures, must be determined accurately. It is therefore necessary to finish, by grinding or the like, the end face of each core and the contact surfaces of the head body, flush therewith, and the spacer on the head body.

Thus, the positioning pins, which project from the finished surfaces, cannot previously be formed integrally on the head body. In other words, separate positioning pins must be formed on the head body after the finishing work, which will complicate the manufacture.

Besides the aligning work, moreover, an assembling work using bolts or the like must be performed separately.

Conventionally, in assembling the print head assembly of the aforementioned type, the armatures are previously mounted on a resilient member, formed of a spring material, for example, thereby forming an armature unit. After the armature unit is attached to the nose of the guide member, the print wires are inserted individually into holes in the respective tip ends of the armatures, and into a guide portion of the nose. Then, the armatures and the print wires are fixed together by brazing or laser welding.

According to such a conventional method of assembling, however, the print wires and the armatures are fixed inside the head body. Therefore, a space for the fixing work must be kept between the tip ends of each two adjacent armatures.

As a result, the assembling work is troublesome and time-consuming, thus entailing an increased manufacturing cost.

SUMMARY OF THE INVENTION

The present invention is intended to settle the aforementioned problems of the prior art print head assembly, and has an object to provide a print head assembly of a printing device in which a print head can be miniaturized easily as a whole, in which components can be assembled and aligned with ease, and which can be manufactured at low cost.

In order to achieve the above object, according to the present invention, the outer peripheral portion of a permanent magnet material is shaped like a polygon, having a pair of first outer peripheral edges extending substantially along a print line, and a pair of second outer peripheral edges extending substantially at right angles to the print line. The distance between the first peripheral edges corresponds to the height of the print head assembly, while the distance between the second peripheral edges corresponds to the width of the assembly.

According to the arrangement described above, compared with the conventional circular configuration, the print head assembly is reduced in height and width, although the permanent magnet member can provide a satisfactory magnetic force without narrowing its effective area for armatures.

If the permanent magnet member is rectangular in shape, for example, its corner portions provide a substantial extension, even though its length and width are shorter than the diameter of the circular configuration. Thus, the assembly can be miniaturized without reducing the effective area.

The reduction of the height and width of a print head is essential to the miniaturization, in particular, of a printing device, such as a printer, using the print head assembly constructed as aforesaid. The proposed arrangement of the present invention can suitably fulfill such a requirement for the miniaturization.

In the print head assembly of the present invention, moreover, retaining projection means protrude along an assembling axis from one of the respective outer peripheral portions of a head body and the guide member having a nose, and engaging means, adapted to releasably engage the retaining projection means, is attached to the other outer peripheral portion. As the projection means and the engaging means engage each other, the head body and the guide member can be joined together, with a supporting member and other components between them.

Thus, the head body can be worked easily without providing any positioning pins thereon, and the positions and stroke of the armatures, relative to the cores, can be settled accurately.

Moreover, the outer peripheral portion of the supporting member or other intermediate member is formed with positioning groove means which engage the intermediate portion of the retaining projection means. With this arrangement, the relative positions, around the assembling axis, of all the members to be combined are fixed at the time of assembling, thereby ensuring accurate positioning.

Thus, the assembling work and positioning operation can be accomplished easily and quickly, without requiring any special positioning means. As a consequence, the resulting assembly is simple in construction, and the manufacturing cost can be reduced considerably.

In a preferred specific arrangement of the present invention, furthermore, print wires, which are previously fixed to their corresponding armatures, are inserted in the nose of the guide member. In a subsequent process of assembling, the armatures are welded to a resilient member by means of the energy of, e.g., laser beams.

In fixing the print wires to the armatures, therefore, the assembling work need not be performed in a narrow space inside the print head. Thus, the assembling efficiency can be improved, and hence, the manufacturing cost can be reduced.

The above and other objects and advantages of the present invention will become more apparent and will be better understood with reference to the following detailed description of the preferred embodiments of the invention taken in conjunction with the accompanying drawings.

DETAILED DESCRIPTION OF THE PREFERRED EMBODIMENTS

Figure 1:
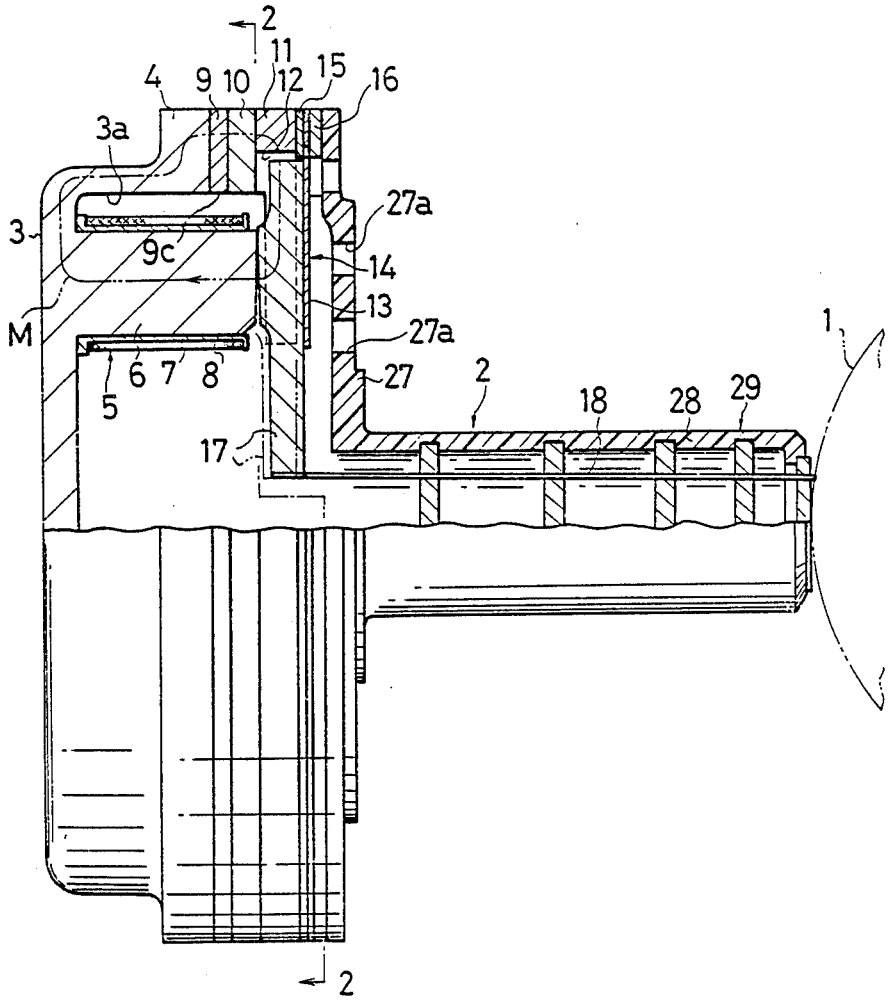
FIG. 1 is a cutaway side view of a print head assembly according to a first embodiment of the present invention.
Figure 2:
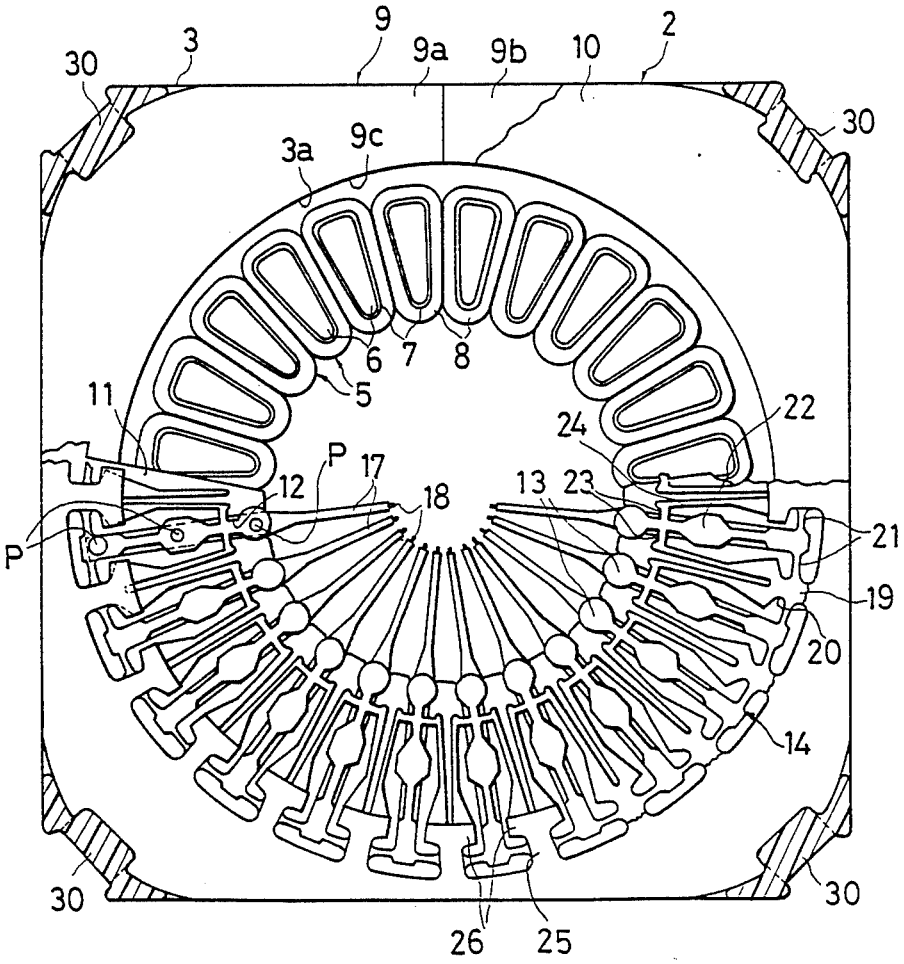
FIG. 2 is a sectional view taken along line 2—2 of FIG. 1.
Figure 3:
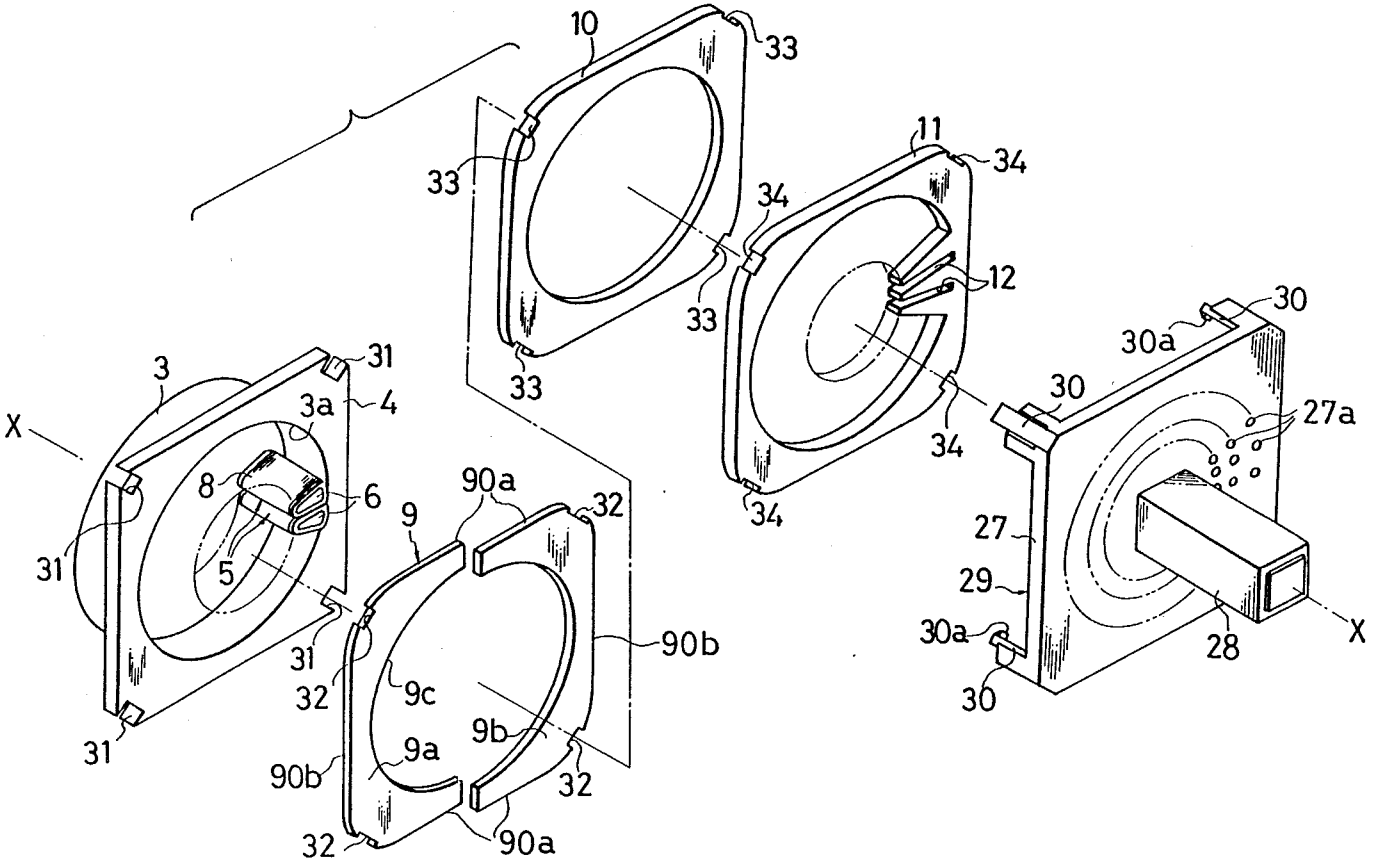
FIG. 3 is an exploded perspective view showing the way principal components of the print head assembly of FIG. 1 are assembled.

As shown in FIG. 1, a print head 2 is disposed in front of a platen 1, which extends in the transverse direction of a frame of a printer, or at right angles to the drawing plane, inside the printer frame. The print head 2 can move along a print line on the platen 1. In the description to follow, that side of the print head 2 which faces the platen 1 will be referred to as the front side, and the opposite side as the rear side. In FIG. 1, a printing sheet wound around the platen 1 and a printing ribbon are omitted for simplicity of illustration. As shown in FIGS. 1 to 3, a head body 3 of the print head 2, which is made of magnetic material, is in the form of a bottomed cylinder having a circular recess 3*a* which opens to the platen side. A flange 4 is formed on the outer periphery of the head body 3 on the open-end side thereof. The flange 4 has a rectangular configuration, including upper and lower sides, extending parallel to the print line, and two lateral sides extending at right angles thereto. The outer peripheral wall of the head body 3, including the flange 4, constitutes a rear yoke.

A plurality of electromagnetic devices 5 (24 in number in this embodiment) are arranged in a ring, on the bottom surface of the recess 3*a*. Each electromagnetic device 5 is composed of a core 6 protruding integrally from the head body 3, a coil bobbin 7 fitted on the core 6, and a coil 8 wound around the bobbin 7. The respective cores 6 of the devices 5 are arranged in a ring, at regular intervals, on the head body 3.

A platelike permanent magnet member 9 is put unmagnetized and fixed on the front face of the flange 4 by adhesive bonding or the like. The magnet member 9 is formed of a pair of half pieces 9*a* and 9*b* arranged symmetrically. The paired pieces 9*a* and 9*b* are butted and fixedly bonded to each other at their facing end portions, and are incorporated in the print head 2. The member 9 has substantially the same external shape as the flange 4, and is formed with a center opening 9*c* which is concentric with the circular ring along which the cores 6 are arranged. A spacer 10, made of magnetic material, is fixed on the front face of the permanent magnet member 9 by adhesive bonding or the like, and a front yoke 11 is bonded to the front face of the spacer 10 by magnetizing the member 9 in the manner mentioned later. The front yoke 11 is formed with a plurality of slits 12 which extend radially, facing their corresponding electromagnetic devices 5.

A resilient member 14 is put on the front face of the front yoke 11 in a manner such that it is sandwiched between a pair of spacers 15 and 16 made of magnetic material. The resilient member 14, which is formed of a resilient plate, has a plurality of radially extending supporting pieces 13 facing the slits 12 individually. A plurality of armatures 17, made of magnetic material, are swingably supported, at their proximal end portions, by their corresponding supporting pieces 13. The respective proximal end portions of the armatures 17 are located inside their corresponding slits 12. Print wires 18, which extend convergently from the central portion of the head body 3 toward the platen 1, are attached, at their proximal ends, to the distal end portions of their corresponding armatures 17. Thus, the resilient member 14, having the supporting pieces 13, constitutes a supporting member for the armatures 17.

Figure 4:
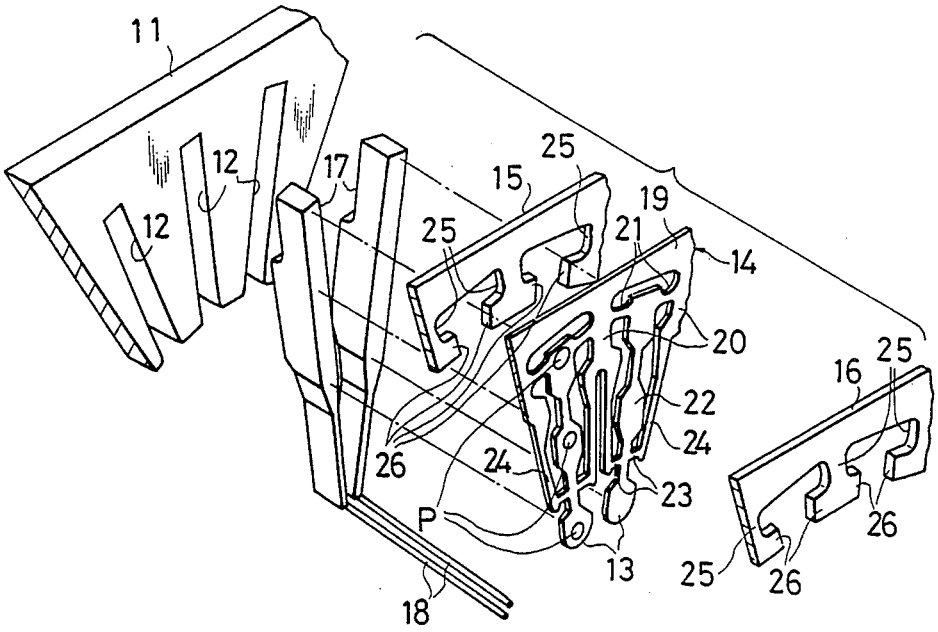
FIG. 4 is an exploded perspective view showing some components of the print head assembly including armatures and a resilient member.

As shown in FIG. 4, an outer peripheral portion 19 of the resilient member 14 is formed integrally with a plurality of coupling portions 20 which are arranged radially between the individual armatures 17. A pair of first torsion bar portions 21 connect each two adjacent coupling portions 20. An armature fixing portion 22 extends radially inward from the junction between the paired first torsion bar portions 21. On the opposite side of the fixing portion 22 to the first torsion bar portions 21, a pair of second torsion bar portions 23 protrude integrally sideways from the fixing portion 22. On each side of each armature fixing portion 22, moreover, the coupling portion 20 and its corresponding second torsion bar portion 23 are connected integrally by means of a leaf spring portion 24.

The first and second torsion bar portions 21 and 23, the armature fixing portion 22, and the leaf spring portions 24 constitute a supporting piece 13 for each armature 17. The armatures 17 are fixed to their corresponding supporting pieces 13 by applying electron beams to positions indicated by circles P in FIGS. 2 and 4, through apertures **27*a* in a cover plate 27 of a guide member 29 (mentioned later), with the armatures 17 on the armature fixing portions 22**.

Spacers 15 and 16 are each formed integrally with projections 25 which extend so as to overlap the coupling portions 20 of the resilient member 14. A pair of holding portions 26 are formed on each projection 25. The holding portions 26 serve to hold the proximal end portions of each two adjacent leaf spring portions 24, at positions inside the first torsion bar portions 21. A guide member 29, having a cover plate 27 and a nose 28, is put on the front face of the spacer 16 so that the cover plate 27 is in contact with the spacer 16. The print wires 18 are movably inserted in the nose 28.

As shown in FIG. 3, four retaining projections 30 protrude integrally rearward from the four corners of the cover plate 27 of the guide member 29, along an axis X—X extending in the member assembling direction, as indicated by a dashed line. A retaining piece **30*a* is formed integrally on the rear end of each retaining projection 30. The retaining pieces 30*a* are adapted to releasably engage the rear face of the flange 4 of the head body 3**.

Recesses 31, 32, 33 and 34 of substantially the same shape are formed at the four corners of the flange 4, the permanent magnet member 9, the spacer 10, and the front yoke 11, respectively. Similar recesses are also formed at the four corners of each of the spacers 15 and 16 and the resilient member. These recesses are adapted to engage their corresponding retaining projections 30. As the recesses of the members 4, 9, 10, 11, 15 and 16 engage the retaining projections 30, these members are successively put on and fixed together to the cover plate 27.

In assembling the print head 2 with the aforementioned construction, the components including the armatures 17 and the print wires 18 are attached to the guide member 29 in the following manner.

The printing wires 18 are previously fixed to their corresponding armatures 17 by brazing or laser welding. The resilient member 14, along with the spacers 15 and 16 and the front yoke 11, is put on the cover plate 27 of the guide member 29. At this time, the retaining projections 30 engage the recesses at the corner portions of the individual members, thereby positioning the members. Then, while inserting all the print wires 18 into the nose 28 of the guide member 29, the armatures 17 are arranged corresponding to the individual supporting pieces 13 of the resilient member 14, and are positioned by means of a suitable jig.

In this state, electron beams or laser beams are applied to the supporting pieces 13 of the resilient member 14 from the outside of the cover plate 27, through the apertures **27*a* (FIGS. 1 and 3) which are formed in the cover plate 27, corresponding to the armatures 17. Thus, by the energy of the beams, the armatures 17 can be welded to their corresponding supporting pieces 13, at the points P (FIGS. 2 and 4) on the opposite faces of the pieces 13 to the guide member 29. At this point time, the attachment of the armatures 17 and the print wires 18 to the guide member 29** is finished, and one assembled unit is completed.

Subsequently, the guide member unit assembled in the aforesaid manner is joined with the head body 3 so as to be in contact with the front face of the spacer 10. In this state, the retaining projections 30 engage their corresponding recesses of the individual members, thereby positioning the members. Then, the permanent magnet member 9 is magnetized to strongly hold the front yoke 11 and the guide member unit by means of its magnetic force. At the same time, the retaining pieces **30*a* are caused to engage the flange 4 of the head body 3**, thereby accomplishing the assembling of the whole structure.

The end faces of the cores 6 and the front face of the spacer 10 are ground so as to be flush with one another, thereby ensuring an accurate positional relation with the armatures 17.

Thus, the armatures 17 and the print wires 18 are previously coupled to one another before they are attached to the nose 28 of the guide member 29. In contrast with the conventional case, therefore, there is no need of a fixing operation in a narrow space inside the head body 3. Consequently, the assembling work is facilitated, and the manufacturing cost can be lowered.

In this embodiment, moreover, the cover plate 27 of the nose 29 is formed with the apertures **27*a* through which electron beams pass. Therefore, the armatures 17 can be fixed to the resilient member 14 on the side of the guide member 29. Thus, the resilient member 14, which is formed of a leaf spring having a high magnetic resistance, is located outside a magnetic path formed by the permanent magnet member 9, so that the magnetic force of the magnet member 9 can be utilized effectively. Furthermore, the direction of irradiation can be controlled with ease, and the armatures 17 are fixed to the resilient member 14 with use of electron beams with high energy density. Accordingly, such small parts as the armatures can be welded securely with small weld spots, and the torsion bar portions 21 and 23 can hardly be influenced by welding heat. Since each supporting piece 13** is formed integrally of one leaf spring, moreover, the resulting assembly is simple in construction, and the assembling work is easier, thus permitting lower manufacturing cost.

In the printing head assembly constructed in this manner, when the coils 8 of the electromagnetic devices 5 are not energized, the permanent magnet member 9 forms a magnetic path which extends through the spacer 10, front yoke 11, armatures 17, cores 6, and flange 4, as indicated by a two-dot chain line M in FIG. 1. As a result, each armature 17 is attracted to the whole end face of its corresponding core 6, and each print wire 18 is situated in its rear or rest position, as indicated by a chain line in FIG. 1. Also, each supporting piece 13 of the resilient member 14 is moved rearward, so that the torsion bar portions 21 and 23 are deformed torsionally, and the leaf spring portions 24 are bent, thereby accumulating an urging force.

In this state, when the coils 8 of the electromagnetic devices 5 are energized selectively so that the cores 6 are temporarily excited to cancel the magnetic path, the armature 17 corresponding to the energized coil 8 is swung around the first torsion bar portions 21 to a printing position, as indicated by a full line in FIG. 1, by the urging force of the portions 21, 23 and 24. Thereafter, the armature 17 is swung back to and held again in its rest position, attracted by the magnetic force of the permanent magnet member 9. As the printing wire 18 reciprocates, accompanying its corresponding armature 17, the printing sheet (not shown) on the platen 1 is subjected to a dot-printing operation with the aid of the printing ribbon (not shown) between the print head 2 and the platen 1.

In this embodiment, the outer peripheral portion of the permanent magnet member 9 has a rectangular outline. As shown in FIG. 3, the outer peripheral portion includes upper and lower first outer peripheral edges 90*a* and a pair of lateral or second outer peripheral edges 90*b*. When the print head 2 is set in the printing device, the first edges 90*a* are situated parallel to the print line, while the second edges 90*b* extend at right angles to the print line. Thus, the distance between the first edges 90*a* corresponds to the height of the print head 2, while the distance between the second edges 90*b* corresponds to the width of the head 2. The members 4, 10, 11 and 27 and other members of the print head 2, which are combined together with the magnet member 9, have an outer peripheral portion whose shape is substantially the same as that of the magnet member 9.

Thus, the height and width of the magnet member 9 are equivalent to those of the print head 2. Even if the height and width are shorter than the diameter of the conventional circular head, the magnet member 9 can enjoy a wide enough area, as a whole, owing to the substantial extension of its corner portions. Despite the compact design, involving a reduction in height and width of the print head 2, therefore, a wide effective area can be maintained which permits production of the magnetic force of the permanent magnet member 9.

In the embodiment described above, the permanent magnet member 9 is rectangular in shape. Alternatively, however, it may have the shape of an octagon or any other polygon.

Figure 5:
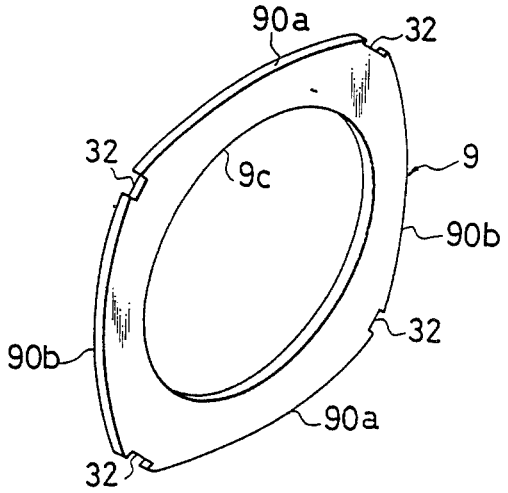
FIG. 5 is a perspective view showing a modification of a permanent magnet member.
Figure 6:
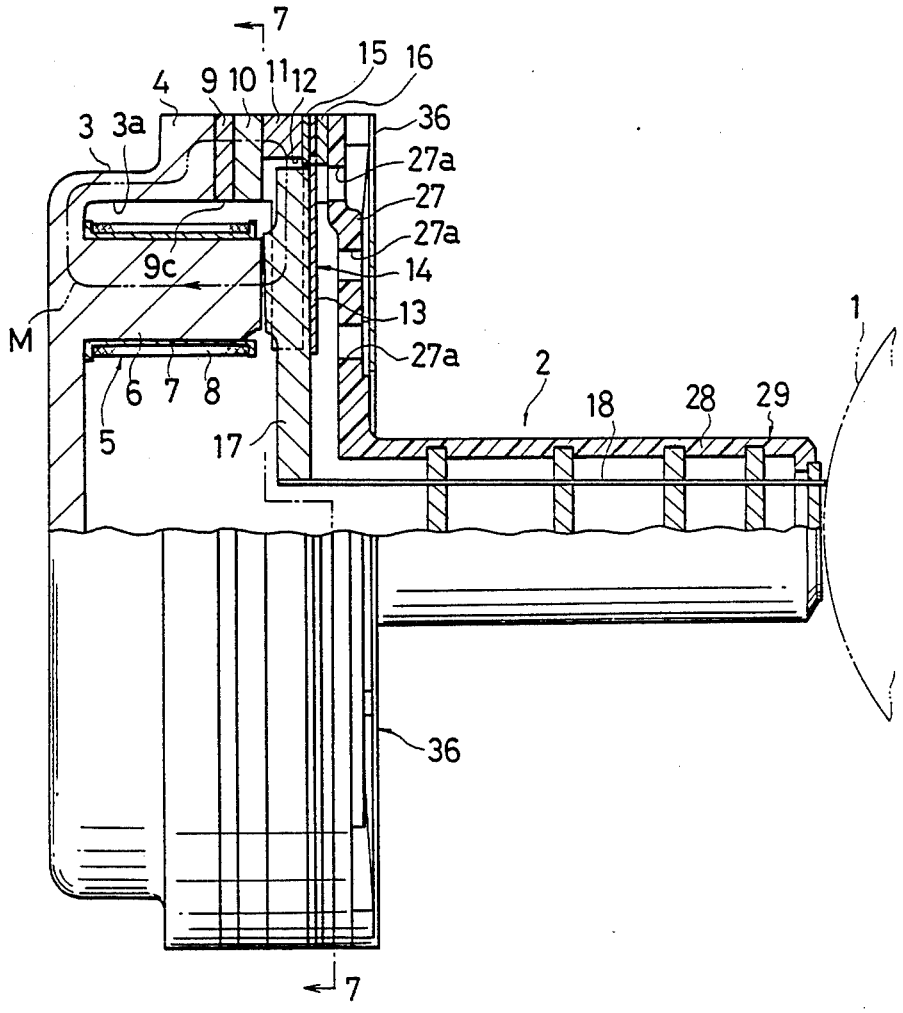
FIG. 6 is a cutaway side view of a print head assembly according to a second embodiment of the present invention.
Figure 7:
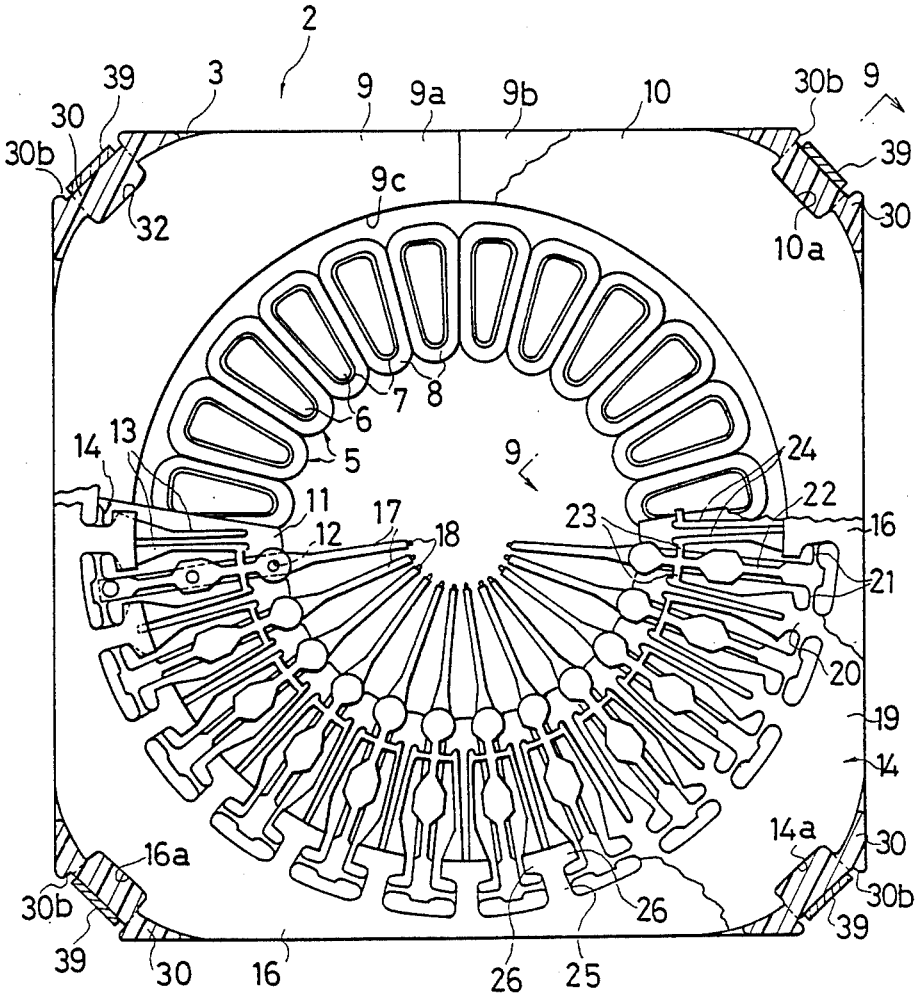
FIG. 7 is a sectional view taken along line 7—7 of FIG. 6.
Figure 8:
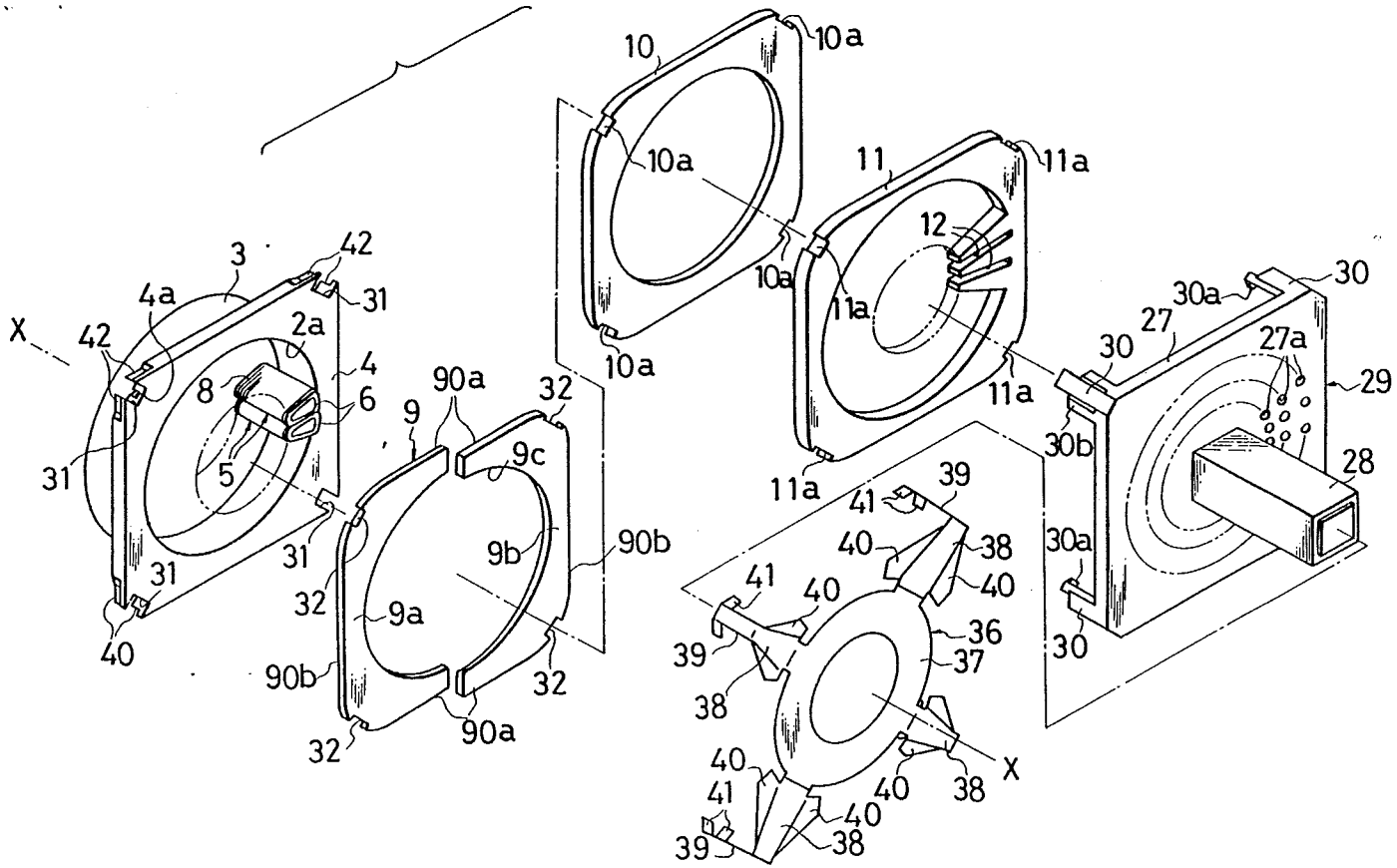
FIG. 8 is an exploded perspective view showing the way principal components of the print head assembly of FIG. 6 are assembled.

FIG. 5 is a perspective view showing a modification of the permanent magnet member. In FIG. 5, like reference numerals refer to like portions as included in the first embodiment. In this modification, the first and second outer peripheral edges 90*a* and 90*b* of the outer peripheral portion, which are defined by straight lines in the first embodiment, are somewhat outwardly convex in shape.

According to the present invention, as described in connection with the first embodiment, the print head 2 is assembled in a manner such that the components 9, 10 and 11 and other components are interposed between the guide member 29 and the head body 3, and that the retaining projections 30 of the guide member 29, which constitute retaining projection means, engage their corresponding engaging recesses 31 of the head body 3, which constitute engaging means. The middle portion of each retaining projection 30 is fitted tight in grooves 32, 10*a* and 11*a*, as positioning groove means, at the corner portions of the respective outer peripheral portions of the members 9, 10 and 11, between the head body 3 and the guide member 29. Thus, the relative positions of all these members, with respect to the direction around the axis X—X extending in the assembling direction, are fixed.

At the time of assembling, the retaining projections 30 are deformed elastically, and the retaining pieces 30*a* are snapped in their corresponding engaging recesses 31 of the head body 3. The engagement is maintained by the resilience of the projections 30. According to this arrangement, in contrast with the prior art arrangement, the head body 3 need not be formed with any positioning pins which penetrate the members. Thus, the manufacture of the print head assembly is facilitated, and the individual members can be bonded together with higher accuracy. Accordingly, the variation of the stroke of each armature is reduced, and the print wires 18 can produce prints of improved uniformity.

In contrast with the arrangement of the aforementioned embodiment, moreover, the retaining projections 30 and the engaging recesses 31 may be provided on the sides of the head body 3 and the guide member 29, respectively.

Referring now to FIGS. 6 to 10, a print head assembly according to a second embodiment of the present invention will be described. The first and second embodiments share most components in common. Therefore, like reference numerals are used to designate like portions or components throughout the drawings for simplicity of illustration.

In the second embodiment, a resilient retaining member 36 is put on the cover plate 27 of the guide member 29, on its front side or on the opposite side thereof to the head body 3.

A ring-shaped central portion 37 of the resilient retaining member 36, which is formed of a spring material, is attached to the front face of the nose 28 of the guide member 29. Extending portions 38 protrude radially from the outer periphery of the retaining member 36, arranged at regular intervals. Retaining arms 39, constituting retaining arm means, extend individually from the extending portions 38, substantially at right angles thereto.

A pair of bent resilient pieces 40 are formed integrally on two opposite sides of each extending portion 38. The resilient pieces 40 engage the front face of the cover plate 27 of the guide member 29. A pair of bent retaining pieces 41 are formed integrally on the extreme end portion of each retaining arm 39. The retaining pieces 41 can be fitted individually in each pair of retaining recesses 42, which are formed in the rear face of the flange 4.

The four retaining arms 39, which extend rearward along the assembling axis X—X, are situated corresponding to the four retaining projections 30 on the guide member 29. When the retaining member 36 and the guide member 29 are joined together, each retaining arm 39 engages a retaining groove 30*b* (FIGS. 7 and 8) on the outer peripheral surface of its corresponding retaining projection 30. Thus, the relative positions of the retaining member 36 and the guide member 29, with respect to the direction around the axis X—X, are fixed.

The retaining recesses 42 in the flange 4*a*are formed corresponding to the individual corner portions of the flange 4 at which the engaging recesses 31 are formed.

Figure 9:
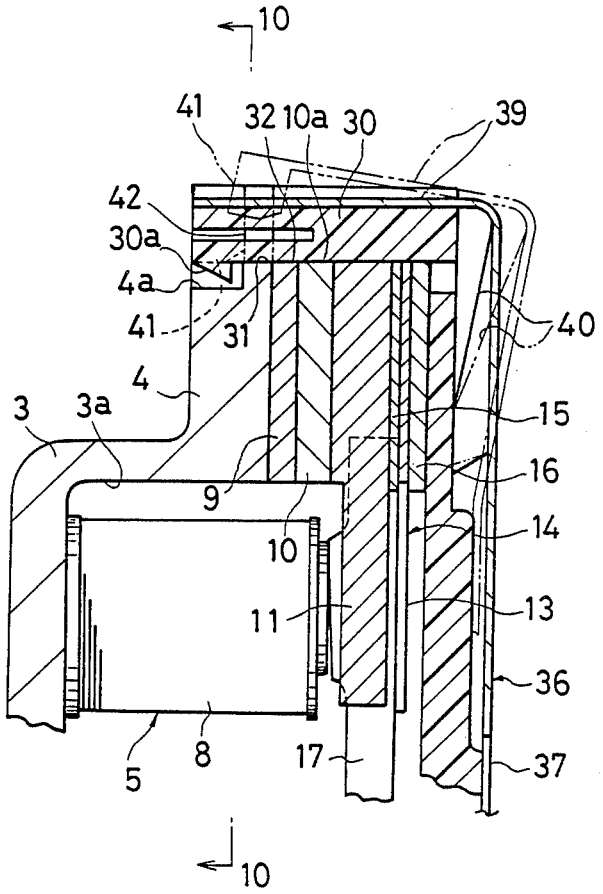
FIG. 9 is an enlarged sectional view of the principal part of the print head assembly as taken along line 9—9 of FIG. 7, illustrating the way a resilient retaining member is mounted.
Figure 10:
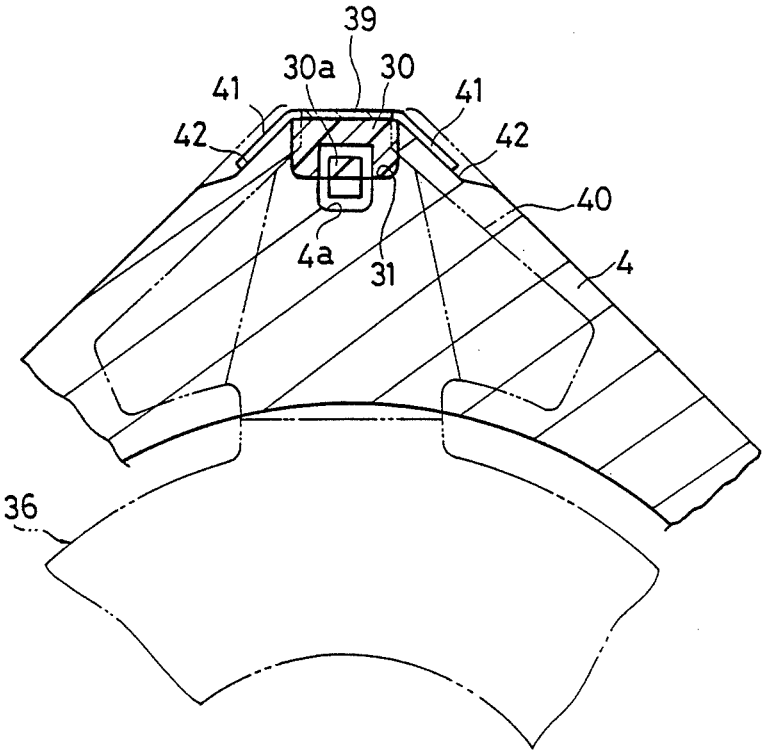
FIG. 10 is a sectional view of the principal part as taken line 10—10 of FIG. 9.

In a natural state, as indicated by a two-dot chain line in FIG. 9, the retaining member 36 is situated so that the retaining pieces 41 of the retaining arms 39 are off the retaining recesses 42. As the retaining arms 39, in this state, are pushed toward the four corners of the head body 2 against their own resilience, the retaining pieces 41 engage their corresponding retaining recesses 42, and the resilient pieces 40 are brought resiliently into contact with the cover plate 27. By such a springy action, the retaining pieces 41 are locked or fixed in the retaining recesses 42. Thus, the assembling state of the print head can be maintained more securely.

In the second embodiment, as in the first embodiment, the retaining projections 30 engage their corresponding engaging grooves 31. The print head is preassembled by fitting the retaining pieces 30*a* of the retaining projections 30 individually in notches 4*a*, which are formed individually on the engaging grooves 31.

Thus, in the second embodiment, the retaining projections 30, having the retaining pieces 30*a*, are used for preassembling, while the resilient retaining member 36 is used for final assembling.

After the retaining pieces 30*a* of the retaining projections 30 are caused, for preassembling, to engage their corresponding notches 4*a*, relatively loosely or just tight enough to prevent disengagement, the permanent magnet member 9 is magnetized. Thereupon, the components 4, 10, 11, 14, 15 and 16 are coupled together by means of the magnetic force of the magnet member 9. Thereafter, the resilient retaining member 36 is used to accomplish the final assembling with high accuracy. Thus, the assembling work can be performed in two steps. Owing to the process of preassembling, the print head assembly cannot be disassembled when it is transferred between processes, before the permanent magnet member 9 is magnetized. Consequently, the assembling work is safe and secure.

Since the retaining arms 39 of the resilient retaining member 36 are situated along the outer peripheral surfaces of their corresponding retaining projections 30, as mentioned before, their middle portions, like those of the retaining projections 30, engage the retaining grooves 32, 33 and 34 of the permanent magnet member 9, the spacer 10, and the front yoke 11, respectively. By this engagement, the relative positions of the individual members can be settled more accurately.

As in the case of the first embodiment, the armatures 17 are fixed to their corresponding supporting pieces 13 of the resilient member 14 by externally applying laser beams or the like through the apertures 27*a* in the cover plate 27, before the guide member 29 is attached to the head body 3. Thus, the fixing operation can be performed very easily.

In the embodiments described herein, the retaining projections 30 are formed integrally on the cover plate 27 of the guide member 29. Alternatively, however, they may be attached separately to the cover plate 27.

It is to be understood that the present invention is not limited to the embodiments described above, and that various changes and modifications may be effected therein by one skilled in the art without departing from the scope or spirit of the invention.

What is claimed is:

1. A print head assembly of a printing device which moves along a print line to perform a printing operation and includes an outer peripheral portion having a specific width in a paralleled direction to the print line and a specific height in a perpendicular direction to the print line, comprising:

a plurality of cores arranged in a circular ring;

a yoke member surrounding and supporting the cores;

solenoid coils wound individually around the cores;

a plurality of armature members arranged individually facing the cores;

a resilient member swingably supporting the armature members and urging the armature members in the one direction by means of its resilient force;

a plurality of print wires operatively connected to the armature members corresponding thereto; and a permanent magnet member fixed to the yoke member and forming a plurality of magnetic paths, each of which passes through the yoke member, one of the cores and one of the armatures, said magnet member urging the armature members in the other direction by means of its magnetic force, said resilient member accumulating an urging force in one direction in such a situation that the armature members are urged in the other direction by the magnetic force of the permanent magnet member, and moving that armature member corresponding to a selected one of the solenoid coils in one direction, by means of the accumulated urging force, when the magnetic force of the permanent magnet member is cancelled by selective excitation of the solenoid coils, thereby driving that printing wire corresponding to the moved armature member toward a printing position, said permanent magnet member including a square outer periphery, having a pair of first outer peripheral edges extending substantially along the print line, and a pair of second outer peripheral edges extending substantially at right angles to the print line, the distance between the paired first outer peripheral edges being equivalent to said specific height of the print head assembly, and the distance between the paired second outer peripheral edges being equivalent to said specific width of the print head assembly said permanent magnet member further having a circular inner periphery to define a center opening which is concentric with said circular ring along which said plurality of cores are arranged, and said yoke member has an outer periphery which is substantially the same form as that of the permanent magnet member.

2. The print head assembly according to claim 1, further comprising:

a second yoke member having a plurality of slits in which each of said armature members is located and an outer periphery which is substantially the same form as that of the permanent magnet member, said permanent magnet member being disposed between said both yoke members.

3. The print head assembly according to claim 1, wherein said pair of first outer peripheral edges are defined by straight lines parallel to the print line, and said pair of second outer peripheral edges are defined by straight lines perpendicular to the print line.

4. The print head assembly according to claim 1, wherein said resilient member has an outer periphery which is substantially the same form as that of the permanent magnet member.

5. The print head assembly according to claim 16, wherein said permanent magnet member includes an inner peripheral portion formed in a ring, corresponding to the circular ring along which said plurality of cores are arranged.

* * * * *